United States Patent [19]

Florindez

[11] 4,192,122

[45] Mar. 11, 1980

[54] AUTOMATIC BAG SUPPLYING MACHINE FOR BREAD BAGGERS

[76] Inventor: Augusto Florindez, 13029 Ocaso Ave., La Mirada, Calif. 90638

[21] Appl. No.: 947,133

[22] Filed: Sep. 29, 1978

[51] Int. Cl.[2] ..... B65B 43/36

[52] U.S. Cl. ..... 53/572

[58] Field of Search ..... 53/571, 572, 573

[56] References Cited

U.S. PATENT DOCUMENTS

| | | | |
|---|---|---|---|
| 3,440,801 | 4/1969 | Prince et al. | 53/572 |
| 3,556,316 | 1/1971 | Rademacher | 53/572 X |

*Primary Examiner*—Travis S. McGehee

*Attorney, Agent, or Firm*—Whann & McManigal

[57] ABSTRACT

A bread packaging device having a stack of bags supported on a table and into which freshly baked bread or the like is inserted for packaging. The apparatus has means whereby when the stack of bags has been exhausted, the wicket and remnant parts are removed and a new stack of bags installed in its place, this being done automatically and without delay so as not to interfere with the movement of the loaves of bread along the conveyor leading from the oven.

9 Claims, 9 Drawing Figures

-22-
-57-
Q
N
S
11
12
13
14
16
19
21
24
27
31
34
45
47
51
52
53
54
55
58
61
62
64
65
66
67
70
71
72
73
75
77
78
81
82
90
91
92
95

FIG. 6.
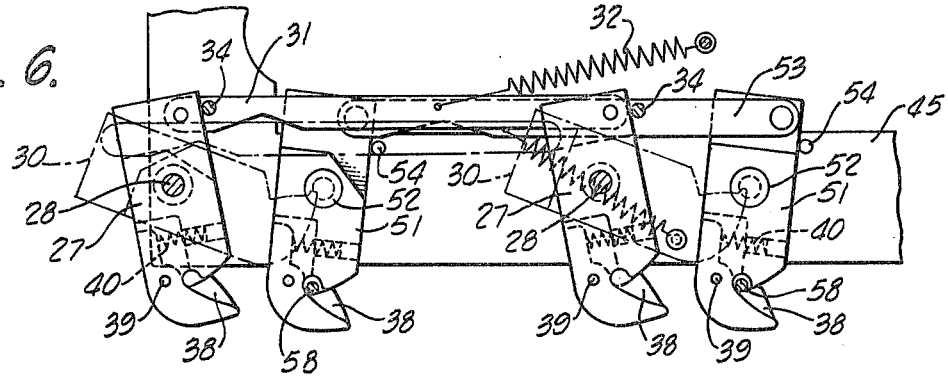
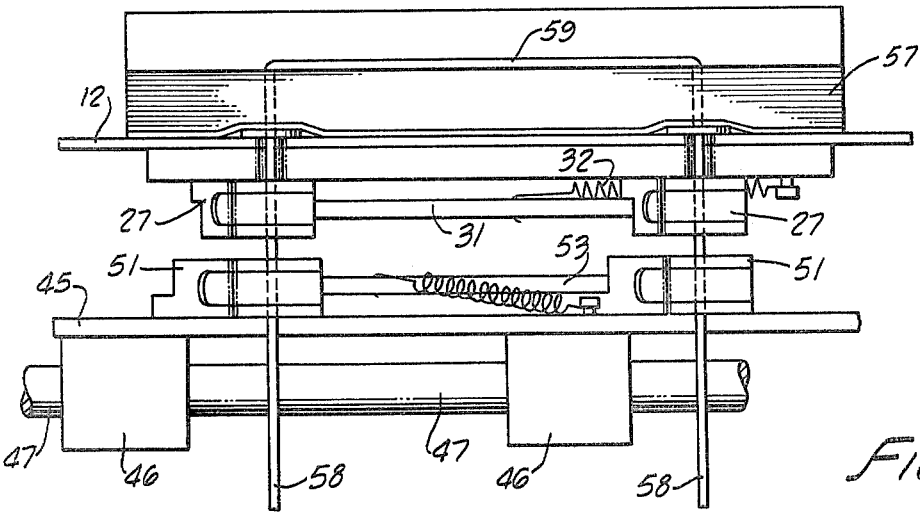
FIG. 7.
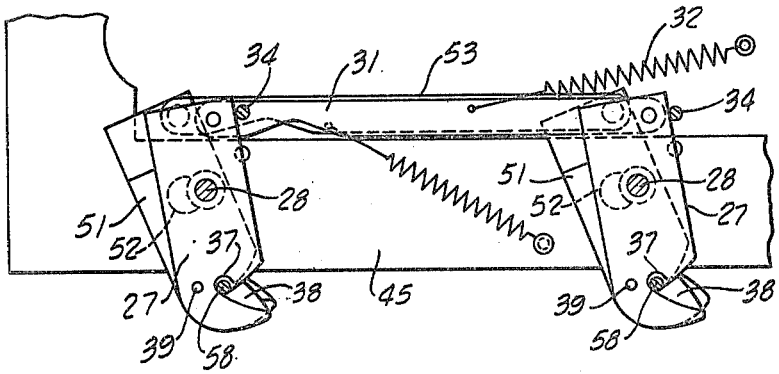
FIG. 8.
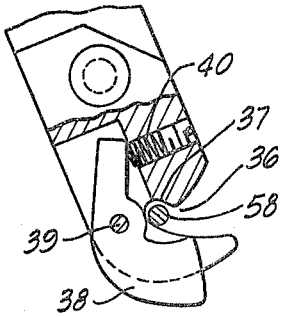
FIG. 9.

AUTOMATIC BAG SUPPLYING MACHINE FOR BREAD BAGGERS

PRIOR ART

In the bakery industry the baked loaves of bread are removed from the ovens and are conveyed to the location where the loaves are inserted into bags prior to shipment. In a large bakery the freshly baked loaves are moved along the conveyor to the bread bagging equipment at the rate of about 65 loaves per minute; and it is necessary to keep a full supply of bags available ready for use so that the movement of the loaves from the conveyor will no be impeded or interfered with.

At the present time the bags are in stacks of about 500 bags, the open end of each bag having small openings through which a wicket is extended in order to hold the bag in position on or in the bagging device. The wicket has a top portion and two depending rods which extend through the openings of the open ends of the bags and the bags are held on the wicket by use of suitable washers and a cardboard backing.

When the stack of bags is about exhausted the apparatus now used in the industry must be shut down, the wicket and remnants removed and a new stack of bags placed on the loading table.

BRIEF DESCRIPTION OF THE INVENTION

Applicant has produced a machine in which when the stack of bags is exhausted, a new stack is automatically installed in its place. This operation is done with the rapidity of an automatic machine; therefore there is no delay in the rate at which the loaves of bread is conveyed from the bread coolers.

It is an object of my invention to replace the manual bag replacing operation by an automatic machine of the type referred to in the preceding paragraph. It is an object of my invention upon using up the bags in the stack to immediately remove the wicket and remnants and to immediately install a new stack of bags. It is an object of my invention to provide an arrangement in which the stack of bags are held in place by clamping or holding means which operates by clamping the rods of the wicket.

It is another object of my invention to provide a vertically movable table on which the stack of bags is positioned and the bags are used one at a time by removing the upper bag. As the bags are removed the table moves upwardly so that new additional bags are constantly being brought into operating position; and in combination with these parts, my invention provides a horizontally movable carrier which has on it a means for removing the wicket and remnants and also has on it a clamping or holding means which moves the new stack of bags into operating position.

Other objects and advantages of my invention will be made evident in the course of the following detailed description of my invention.

BRIEF DESCRIPTION OF THE DRAWINGS

Referring to the drawings:

FIG. 6 is a cross sectional view looking downward from the line 6—6 of FIG. 5 with the parts enlarged to clearly show and illustrate the position of the different clamping or holding means in the positions they occupy when the new stack of bags is being moved into operating positions;

FIG. 7 is a fragmentary view showing the position of the parts which engage and release the vertical rods of the wicket in the position they occupy when the rods are being transferred from the holding or clamping means on the carriage to the holding or clamping means on the table or support;

FIG. 8 is a fragmentary view showing the clamping means and the manner in which they are rotated into positions in which they will not be in the way of the returning carriage to its original position; and FIG. 9 is a fragmentary sectional view showing the clamping or holding means and the closure member in an open position where it is receiving in its seating area the rod of the wicket.

BRIEF DESCRIPTION OF THE PREFERRED EMBODIMENT

Figure 1:
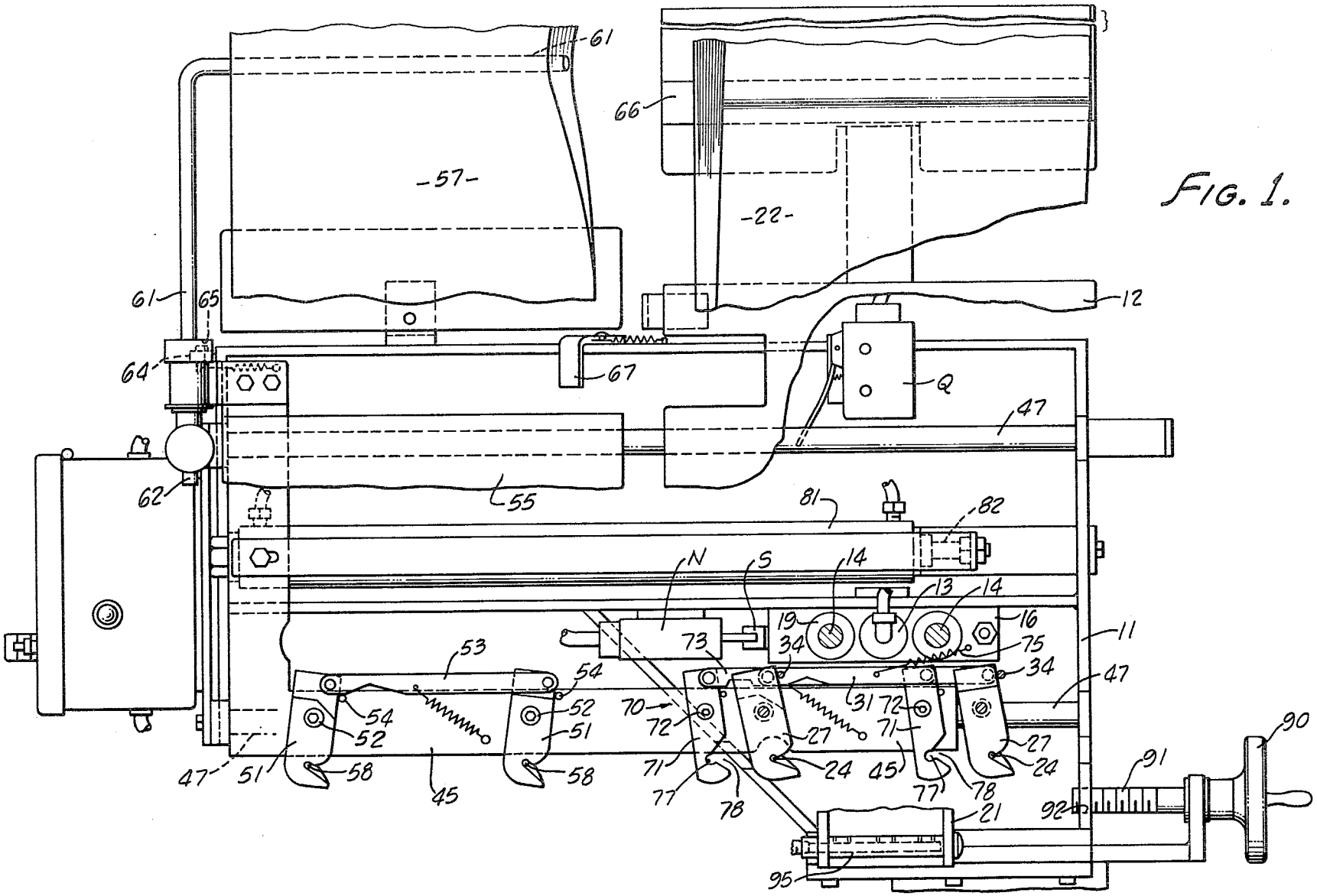
FIG. 1 is a plan view of my invention taken on the line 1—1 of FIG. 2 so that the table and platforms will not be shown, and the mechanism for handling the stacks of bags will be shown clearly in full lines.

Referring to the drawings, my invention provides a main structure 11 which supports the various operating parts of my invention. The bagging table or support means 12 is vertically movable being supported on vertical guide rods 14 which are carried in openings 15 formed on a bearing block 16.

For enhancing movements of the parts and particularly the sliding of the stack of bags from one position to the other, the parts are not exactly horizontal or exactly vertical. It is to be understood therefore that when the words "horizontal" and "vertical" are used, these words are to be construed to refer to the parts even though they are not exactly horizontal or vertical.

Figure 5:
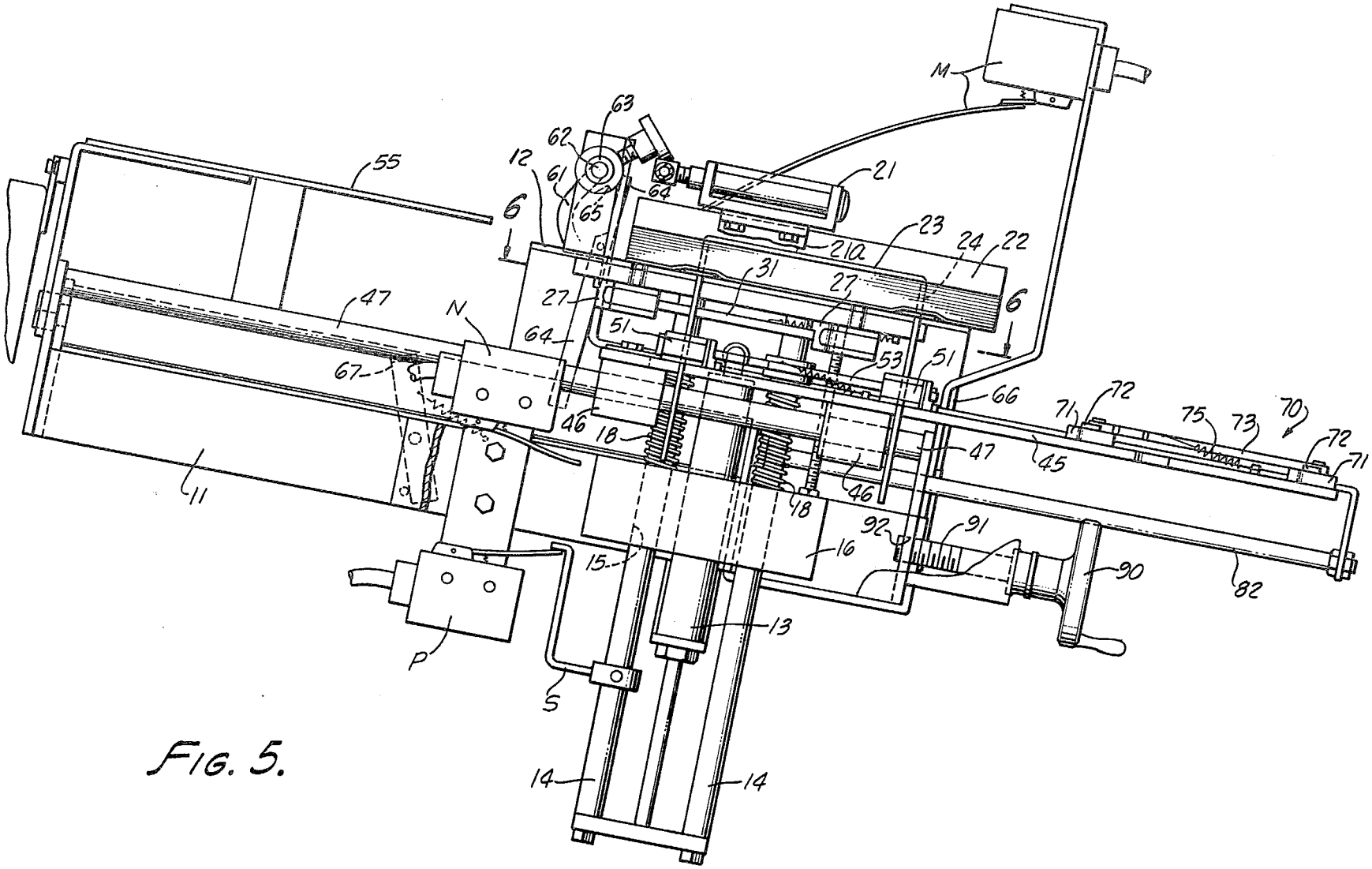
FIG. 5 is a side elevational view of the parts shown in the position similar to that of FIG. 4.

Associated with the table 12 is a cylinder and piston arrrangement 13 whereby the table 12 can be moved to its lowermost position as shown in FIG. 5, for example, against operation of the springs 18 surrounding the rods 14 and being held under compression by collars 19. These springs being under pressure and exerting an upward force on the collars 19, will raise the table as the bags are being used in accordance with the details which will be explained shortly.

Figure 3:
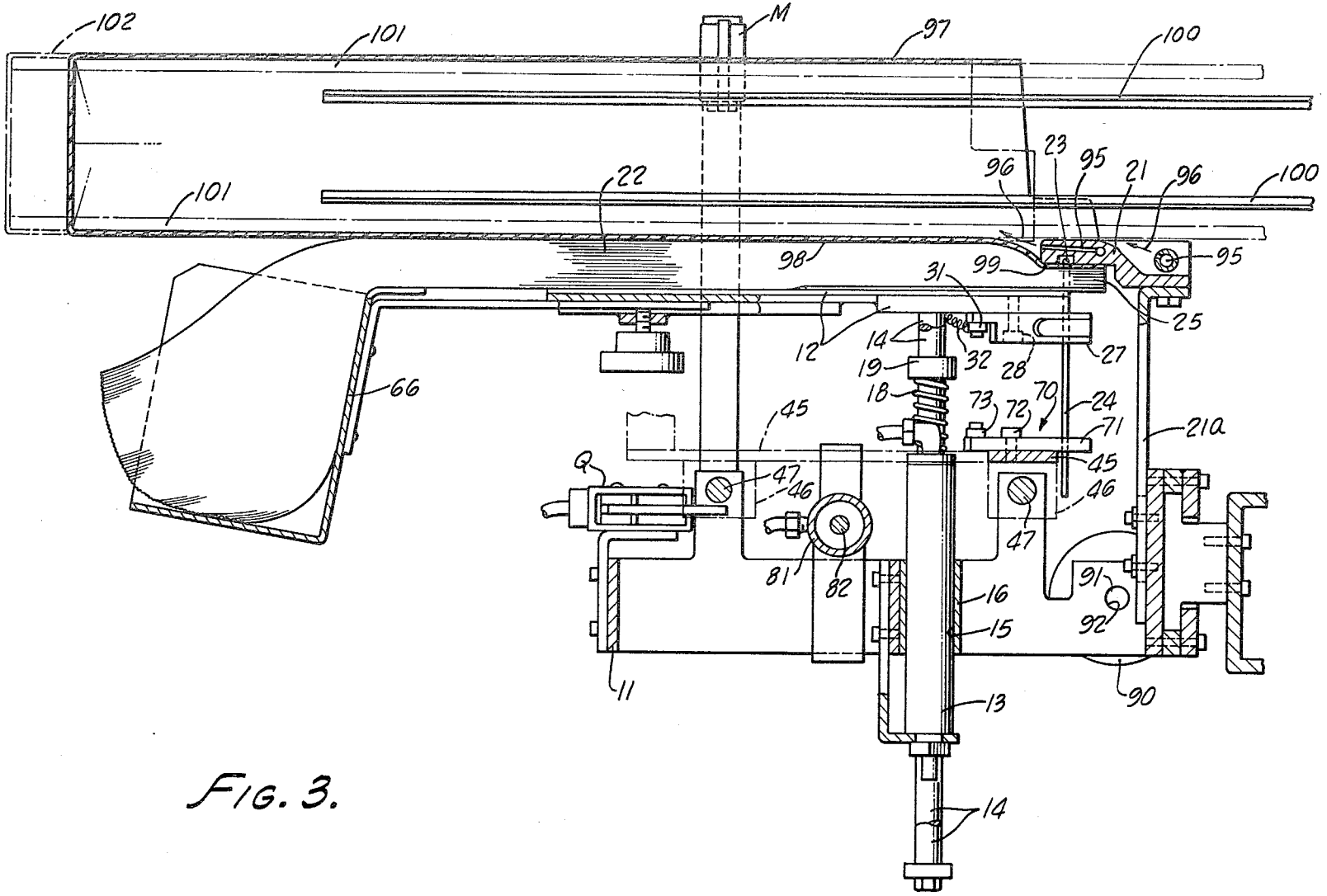
FIG. 3 is a sectional view taken along the line 3—3 of FIG. 2.

As shown best in FIG. 3, there is the stationary clamp 21 positioned above the end of the table. This clamp 21 is mounted on bracket **21*a* secured to the main structure of the apparatus. The stack of bags indicated at 22 have their open ends below the clamp. The wicket of the stack of bags assembly is shown at 23 and has downwardly projecting rods 24. Under the action of the springs 18 the table pushes upwardly and the end or ends of the bags 25 are clamped between the table and the clamping element 21**.

Mounted on the underside of the table are rod compressors or clamps or holding means 27 which as shown are arranged in pairs. The clamps 27 as shown in the enlarged views, FIGS. 6 and 7, are pivoted to the table by pins 28 so that they may swing from full line position to FIG. 6 to the broken line position 30. The two holding elements are connected together by a tie rod 31 so that they move or pivot together, the spring 32 tending to hold the parts 27 in full line position at all times, the parts 27 being held against stops 34. Each of the clamps or holding elements or holding means is constructed as shown in FIG. 9. It will be noted that the clamp or holding means has an opening 36 on the right side which leads to a vertical seat 37, which, when the rod 24 is in place, and the closure member 38 in closing position, the rod will be completely surrounded and therefore the rod cannot move horizontally or sidewardly with respect to the clamping means but can only move vertically with respect thereto. This is provided so that as the bags are being used and are being moved upwardly, the wickets move downwardly with respect to the table. The closure member 28 pivots on the pivot 39 being normally held in closed position by the spring 40.

There is a bag shifting frame or carrier 45 having bearings 46 positioned on horizontal rods 47 which in turn are mounted on the supporting frame. This frame carries the various parts of my invention which function to remove the wicket and remnant parts when the stack of bags is exhausted to support a new stack of bags in a position ready for installation on the bagging table or support and the means whereby the new stack of bags is moved over onto the table in operating position and with the rods of the wicket mounted in the holding or clamping means 27.

Figure 2:
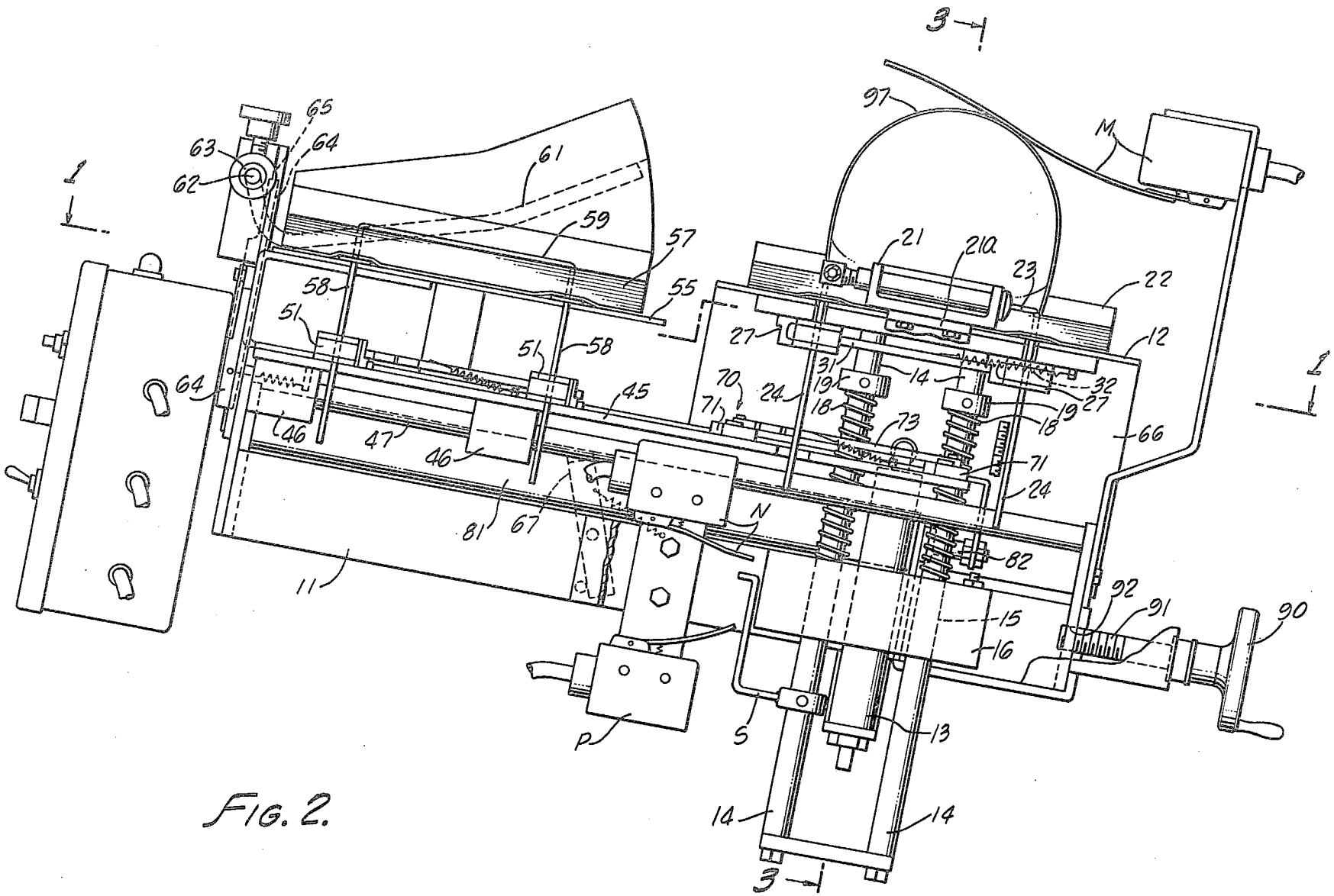
FIG. 2 is an elevational view of FIG. 1 showing the parts in a position in which the bag supply is partly exhausted and in which the bagging table or support means is in a partly raised position.
Figure 4:
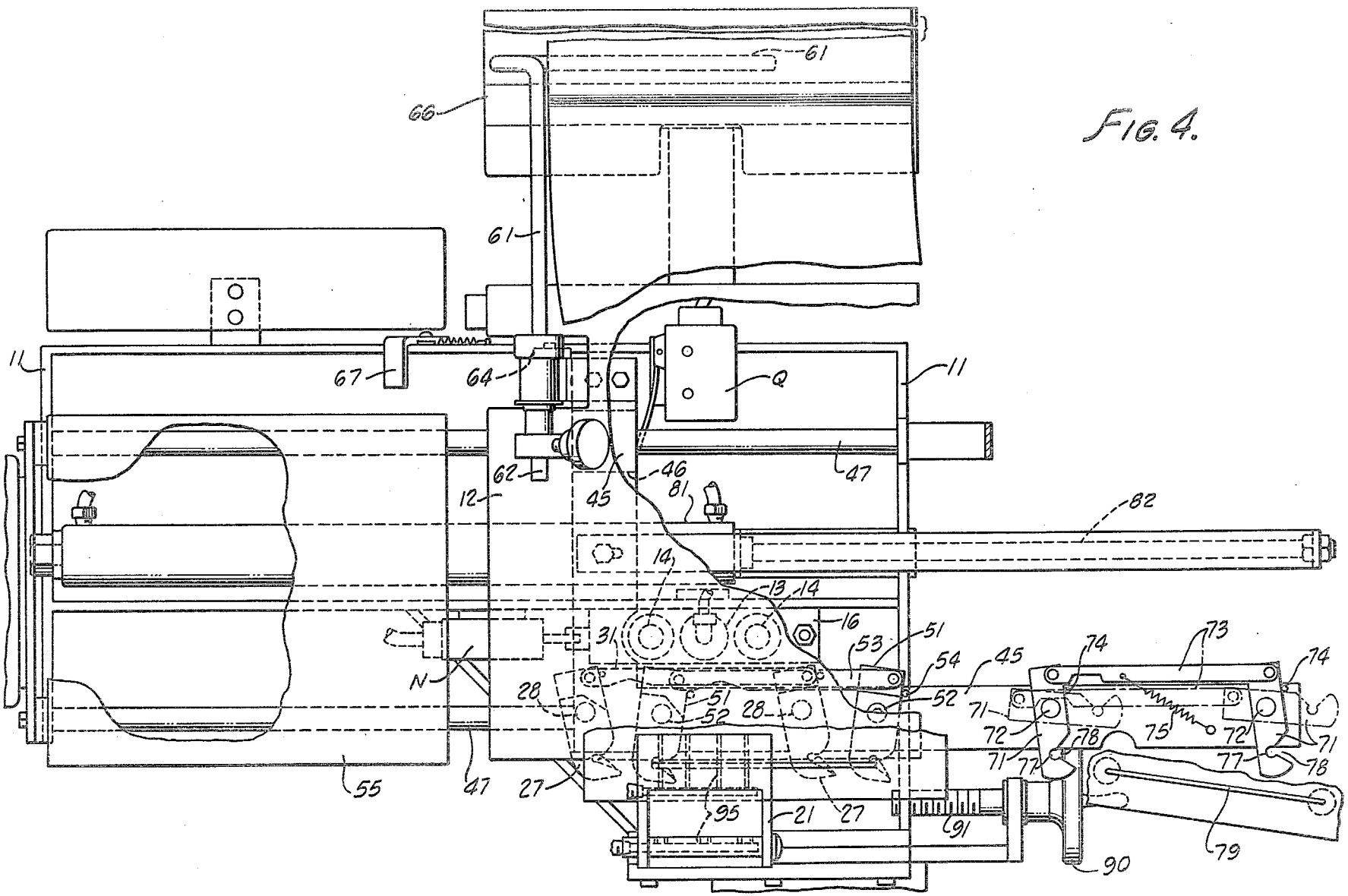
FIG. 4 is a plan view of my invention showing the parts and particularly the carrier of my invention positioned in a rightward position and showing the parts shortly after the wicket and bag remnants have been removed from the support means and are shown on the right being released and ready to drop to a bin or other collecting receptacle.

As shown in FIG. 2 and FIG. 4 mounted below the horizontal plate 55 at the leftward end of the carrier are a pair of clamping means or holding means 51 having an entrance face in the rightward direction which are of substantially the same construction as the element shown in FIG. 9. The clamping means 51 are pivoted on pins 52. They are connected together by a tie rod 53 and they are held in the position shown in FIGS. 1 and 2 with their ends against the stops 54. These clamping means 51 and associated parts are bag shifting clampers whereby the bags or a new stack may be moved into operating position with respect to the bagging or support 12.

Directly above the bag shifting clampers is a table 55 which is stationary. As shown best in FIG. 2 the operator has manually placed a fresh stack of bags 57 on the table with the ends of the bag extending over the edge thereof so that the vertical rods 58 of the wicket 59 may project downwardly and be held by the holding or clamping parts 51. The remainder of the stack of bags is supported by the table 55 with this exception.

Because the bag stack must be shifted over to the vertically movable table 12, it is desirable to prevent the bag stack from applying all of its weight to table 55 thus creating friction. My invention provides a holder for holding up the tail or bottom ends of the bags. This consists of an arm 61 shown in dotted line position and in partial full line position in FIG. 3. The tail position has a portion 62 which is rotatable in bearing 63 which is secured to and is movable with the carriage. If the stack of bags has been positioned by the operator as just described, the tail holder 61 is swung in an anticlockwise direction into the position shown in FIG. 2. In this position most of the weight of the bag stack is removed from the table 55. The arm is held in the position shown by a spring latch 64 which fits into a groove and bears against the shoulder 65 which prevents the tail holder from moving downwardly until the tail holder latch is engaged by the disengager element 67 on the support frame. This releases the spring latch and permits the arm to move downwardly into a non-operative position in which it no longer supports the tail end portion of the bags. At this time the tail portions of the bags are carried in a supporting bucket structure 66 of the table 12, as shown in FIG. 3.

Referring now to the structure which removes the bag wickets and remnants from the support, your attention is directed to the wicket removing means 70 having two spaced rod engaging elements 71 pivoted to the top surface of the plate 45. Each of the wicket removing elements 71 is pivoted at 72. They are held together by a tie rod 73 and are held against stops 74 by the spring 75 which tends to pull the tie rod 73 in a rightward direction. Each of the elements 71 has a vertical pocket 77 with an entrance 78 thereto on the right side thereof.

When the carrier moves from left to right, the wicket removers are moved into a position directly below the clamper means 27 which are pivotally mounted on the lower side of the table 12. At this time the wicket rods enter the pockets 77 and upon further movement of the carriage to the right, the wickets are forceably removed from the clamping means on the table. This is done by pressure which forces the closure members in an open position. As movement of the carriage continues the wickets are removed from their operating position on the table and into the position shown in FIG. 4 where the wickets and remnants at 79 have been moved entirely to the right of the machine and are shown as being in a position to fall into a receptacle.

During this operation the holding elements 51 have moved to a position in which they are to the right of the normal operating position of the bag stack on the support. This is shown best in FIGS. 5 and 6.

The holding elements 51 are to the right of the clamper members 27 which clamp the vertical rods when the bag stack is in operation. At this time the frame engages the microswitch 80 and is engaged by a part of the carrier. This operates a valve which changes the flow of air into the cylinder 81. This causes the piston rod 82 to move from extended position to retracted position and move the carrier from the position shown in FIGS. 4 and 5. The initial leftward movement moves the holding means 57 and the bag stack carried thereby from the position shown in FIG. 6 to the position shown in FIG. 7. It will be noted that the holding means 57 is directly below the clamping means 27. During this operation the vertical rods 58 have opened the latch 38, FIG. 9, and fit in the seating opening 37. Because the compressors 27 are in the position in which the stop pins 34 are engaged, forward movement of the carriage will move the holding means 57 to the left. However, the rods 58 cannot move further than the position shown in FIG. 7 with the result that the rods are firmly engaged between compressors 27 and the holding means 57 will move rightwardly. The pressure of the rods against the closure member 38 opens the closure member as shown in FIG. 9 and the holding means and carriage return to their normal positions as shown in FIG. 1 leaving the rods 58 and the fresh stack of bags in normal operating position as shown in FIG. 8.

Also the tail of the bags rests in the pocket 66 as shown in FIG. 3.

When the carrier has returned to its original position, air is exhausted from the cylinder 13 and the compressed springs 18 move the vertical rods 14 which carry the table 12 upward into a position in which the uppermost bag of the stack is brought into engagement with the stationary clamp 21 thus clamping the open end of the bags firmly in place. If necessary in order to align the table with the bread conveying apparatus, the hand wheel 90 may rotate the threaded shaft 91 which fits in threaded opening 92 whereby the stack of bags is brought into proper alignment.

The sequence of operation of my invention is substantially as follows. It is to be understood that although these various operations may be performed manually they also may be performed automatically by placing control switches, etc. and timer equipment in their proper position. Such equipment, however, is well known to those skilled in the art and many such details have not been shown and will not be described.

The first step in the sequence of operation is to supply air to the nozzle 95 formed in the clamp 21. The air shoots to the left as indicated by the arrow 96 which forces the upper wall 97 into the position shown in FIG. 3, thus expanding the bag. The lower wall 98 of the bag which has a tab 99 engaged by the clamp remains in position in contact with the upper surface of the remaining bags of the stack. At this time the arms 100 of the conveying apparatus are moved leftwardly into the bag as shown in FIG. 3. As they reached fully entered position, the arms are spread apart as shown in dotted line position 101. The bag is moved leftward a small distance into the position shown in broken lines 102. This tears the bag from the table 99 which is clamped under the clamp 21. Because the arms 100 are in engagement with the upper and lower walls of the bag, the movement of the arms to the right pulls the bags to the right and over the bread.

During the period of time that the stack of bags are being exhausted the operator places a fresh stack of bags on the table 55 with the parts positioned as shown in FIG. 2.

When the last bag of the stack in operating position is used up, the table 12 is in its upper position and the switch arm of the switch "N" is engaged by the bracket "S" on one of the rods 14. At the same time, as there is no inflated bag and there will be none since the bags have been exhausted, the arm of the switch "N" will not be engaged and the bagger machine will be shut off. When this happens, a time relay will start its sequence at the same time the bagger stops and an alarm will be engaged to let the operator know that the machine will start its sequence of operation to replace the exhausted stack of bags. The alarm warns the operator to set another set of bags on the table 55 so that the machine will be ready for the next sequence of operations. After the warning period, air is immediately supplied to the air cylinder 13 and the table will be dropped to its lowermost position as shown in FIG. 5. At that time the bracket "S" will close switch "P". The shaft 82 will be extended rightwardly and all of the parts on the carrier are moved with it and the functions of the various parts in removing the remnants of the exhausted stack and installing the new stack are performed as previously described. Also when the carrier is moved to its extreme rightward position, the switch "Q" will be closed and a valve operated to discontinue air being supplied to the left end of the cylinder 81 and supplied to the right end of the cylinder 81 in order to retract the piston rod and move the carriage and its parts to its original position. When the carrier has been returned to its original position, all of the other parts, including various switches and electrical circuits will also be returned to their original positions and the bagger will then start operating and will go through further cycles of the operations as previously described.

The complete operation of removing the remnants of the exhausted stack and replacing the exhausted stack with a new stack of bags requires but one or two seconds, depending upon the setting of the timer. There is, therefore, substantially no delay in the bagging operation and the operation of all of the parts continues without any substantial interruption in time. This causes the carrier to move leftwardly from the position shown in FIGS. 1 and 2 toward the position shown in FIGS. 4 and 5.

Because the rods 58 of the stack of bags 57 are being held by the holding means or clamping means 51, the bag assembly is moved rightwardly on the table 55 whereafter it drops a slight distance and slides over the vertically movable support 12 and into the position shown in FIG. 5. As explained heretofore the parts are slightly declined toward the right so the fresh stack of bags may move freely. During this operation, as previously described, the latch structure 64 is released and the arms 61 are dropped to a lowered position, thus allowing the tail of the bags to drop into the pocket 66.

The apparatus then continues to operate until the fresh stack of bags is required; then the sequence of operation is repeated.

Although I have referred to the article being bagged as bread, it is obvious that my invention may be used in connection with bagging of other foods or articles.

I claim:

1. An article bagging device of the class described comprising:

a. a support means, carrying a stack of bags held in stack form by a wicket having downwardly projecting rods and into which individual bags, the article to be bagged is inserted;

b. clamping means on said support means engageable with said downwardly extending rods to hold said stack of bags in place;

c. holding means for holding a stack of replacement bags which are to be used to replace the bags on said support means when they become exhausted, said holding means having clamper elements for clamping the vertical rods of said replacement stack of bags; and d. means for moving said remnants of said stack of bags on said support from said support means and replacing said stack by a fresh stack of bags, and having means for removing said rods from the clamping means of said first stack of bags and moving said replacement stack of bags into operating position whereby they are held in place by said clamper means.

2. A combination as defined in claim 1, including:

a clamp element above said support means and means for pressing said support means upwardly to hold the stack of bags against said clamp.

3. A combination as defined in claim 2, in which:

said support means moves upwardly in small amounts after bags are used from the top of said stack.

4. The combination as defined in claim 1, in which:

said means for removing wickets and remnants from said support means forceably detaches the vertical rods from the clamping means mounted on said support means.

5. An article bagging device of the class described comprising:

a. a support means, carrying a stack of bags held in stack form by a wicket having downwardly projecting rods and into which the individual bags the article to be bagged is inserted;

b. clamper means on said support and pivoted on said support from holding position in a removal direction, said clamper means having vertical seat entrance on said removal side, said vertical seats permit the movement of said rods relative thereto in a vertical direction;

c. a horizontally movable carrier movable from below;

d. rod removing means on said carrier attached to engage said rods and to remove the rods from the clamping means on said support means; and e. replacement bag holding means on said carrier for holding a stack of replacement bags, said replacement bag holding means being pivoted to said carrier and having vertical seat means and an entrance on the removal side thereof.

6. A combination as defined in claim 5, with:

means on said carrier for supporting the tail portion of the stack of bags while said stack of bags is being moved into operating position on said support means.

7. A combination in a bagging apparatus of the class described for removing the remnants of exhausted stacks of bags and installing a fresh stack of bags which stacks of bags including a multiplicity of bags having wickets including depending rods, there being a support on which said stack of bags are positioned with the rods of said wickets depending therefrom:

a. a pair of clamping elements mounted on said support means having vertical seats and side openings formed in said clamping elements to provide entrance openings for said seats on a downstream or removal side thereof; and b. rod removal means supported for sideward movement and including rod engaging seats with side openings therefor, and means for moving said removal means in a downstream direction for engaging said rods and forceably removing said rods from the seats of said clamping elements.

8. A combination as defined in claim 7, also including a bag stack, holding means mounted on said means for moving said rod moving means, said holding means having a pair of vertical clamps with vertical seats with side openings therefor, said means for moving said rod removal means moving the parts in downstream direction so that said holding means for said fresh stack of bags is on the downstream side of the moving elements, said moving means being movable in the opposite direction to move said rods into the seats of said clamping elements.

9. A combination as defined in claim 8, in which said clamping elements are pivoted on a vertical axis so as to be swung into a non-operating position as the rods of said replacement stack of bags is moving past said clamping means in a downstream direction.

* * * * *